US009290874B2

(12) United States Patent
Mathews et al.

(10) Patent No.: US 9,290,874 B2
(45) Date of Patent: Mar. 22, 2016

(54) BACKING MATERIAL SHIFTER FOR TUFTING MACHINE

(71) Applicant: Card-Monroe Corp., Chattanooga (Hixson), TN (US)

(72) Inventors: Ricky E. Mathews, Sale Creek, TN (US); Marshall Allen Neely, Soddy Daisy, TN (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 14/681,516

(22) Filed: Apr. 8, 2015

(65) Prior Publication Data

US 2015/0292131 A1 Oct. 15, 2015

Related U.S. Application Data

(60) Provisional application No. 61/977,292, filed on Apr. 9, 2014.

(51) Int. Cl.
*D05C 15/14* (2006.01)

(52) U.S. Cl.
CPC ..... *D05C 15/14* (2013.01)

(58) Field of Classification Search
CPC ..... D05C 15/08; D05C 15/14; B65H 23/188
USPC ..... 112/80.31, 80.32, 80.73
See application file for complete search history.

(56) References Cited

U.S. PATENT DOCUMENTS

| | | | |
|---|---|---|---|
| 2,818,037 | A | 12/1957 | McNutt |
| 2,840,019 | A | 6/1958 | Beasley |
| 2,932,181 | A | 4/1960 | MacCaffray, Jr. |
| 2,968,856 | A | 12/1961 | Allen |
| 3,016,029 | A | 1/1962 | Card |
| 3,084,645 | A | 4/1963 | Card |
| 3,393,654 | A | 7/1968 | Barnes |
| 3,490,309 | A | 1/1970 | Hesz |
| 3,585,948 | A | 6/1971 | Cobble |
| 3,688,804 | A | 9/1972 | Brown et al. |
| 3,688,808 | A | 9/1972 | Uehera |
| 3,701,464 | A | 10/1972 | Crum |
| 3,806,013 | A | 4/1974 | McGann |
| 3,842,767 | A | 10/1974 | Short |
| 3,865,059 | A | 2/1975 | Jackson |
| 3,908,881 | A | 9/1975 | McCann |
| 3,919,953 | A | 11/1975 | Card et al. |

(Continued)

OTHER PUBLICATIONS

International Search Report and Written Opinion mailed Jun. 30, 2015, for related application No. PCT/US2015/024927.

*Primary Examiner* — Nathan Durham
(74) *Attorney, Agent, or Firm* — Womble Carlyle Sandridge & Rice, LLP

(57) ABSTRACT

A backing material shift system for controlling movement of a backing material through a tufting machine includes spaced, first and second backing feed roll assemblies each carrying a series of reduced length backing feed rolls. The backing feed rolls are connected in series, with their opposite ends being supported by a series of roll stabilizing blocks. The backing feed roll assemblies are slidably supported along the frame of the tufting machine and are movable or shiftable across the tufting zone of the tufting machine in a direction transverse to the path of travel or feeding of the backing material through the tufting machine by operation of a backing material shifter.

14 Claims, 9 Drawing Sheets

(56) References Cited

U.S. PATENT DOCUMENTS

| | | | |
|---|---|---|---|
| 3,934,524 | A | 1/1976 | Smith |
| 3,982,491 | A | 9/1976 | Herzer et al. |
| 4,048,930 | A | 9/1977 | Card |
| 4,089,281 | A | 5/1978 | Landoni |
| 4,100,863 | A | 7/1978 | Shortie, Jr. |
| 4,103,629 | A | 8/1978 | Card |
| 4,127,078 | A | 11/1978 | Spanel et al. |
| 4,134,347 | A | 1/1979 | Jolley et al. |
| 4,193,358 | A | 3/1980 | Woodcock |
| 4,224,884 | A | 9/1980 | Shortie, Jr. |
| 4,254,718 | A | 3/1981 | Spanel et al. |
| 4,255,050 | A | 3/1981 | Beckstein et al. |
| 4,261,498 | A | 4/1981 | Short |
| 4,267,787 | A | 5/1981 | Fukuda |
| 4,303,189 | A | 12/1981 | Wiley et al. |
| 4,365,565 | A | 12/1982 | Kawai et al. |
| 4,366,761 | A | 1/1983 | Card |
| 4,370,937 | A | 2/1983 | Denny |
| 4,399,758 | A | 8/1983 | Bagnall |
| 4,401,024 | A | 8/1983 | Frentress |
| 4,432,296 | A | 2/1984 | Grondin |
| 4,440,102 | A | 4/1984 | Card et al. |
| 4,445,447 | A | 5/1984 | Bardsley et al. |
| 4,501,212 | A | 2/1985 | Slattery |
| 4,549,496 | A | 10/1985 | Kile |
| 4,557,208 | A | 12/1985 | Ingram |
| 4,586,445 | A | 5/1986 | Card et al. |
| 4,597,344 | A | 7/1986 | Stutnacker |
| 4,619,212 | A | 10/1986 | Card et al. |
| 4,630,558 | A | 12/1986 | Card et al. |
| 4,653,293 | A | 3/1987 | Porat |
| 4,653,413 | A | 3/1987 | Bagnall |
| 4,665,845 | A | 5/1987 | Card et al. |
| 4,669,171 | A | 6/1987 | Card et al. |
| 4,682,554 | A | 7/1987 | Goto et al. |
| 4,686,918 | A | 8/1987 | Hjalmer et al. |
| 4,786,177 | A | 11/1988 | Beckstein et al. |
| 4,790,252 | A | 12/1988 | Bardsley |
| 4,794,874 | A | 1/1989 | Slattery |
| 4,815,401 | A | 3/1989 | Bagnall |
| 4,815,402 | A | 3/1989 | Price |
| 4,815,403 | A | 3/1989 | Card et al. |
| 4,817,541 | A | 4/1989 | Magourik |
| 4,829,917 | A | 5/1989 | Morgante et al. |
| 4,831,948 | A | 5/1989 | Itoh et al. |
| RE32,967 | E | 6/1989 | St. John et al. |
| 4,836,118 | A | 6/1989 | Card et al. |
| 4,867,080 | A | 9/1989 | Taylor et al. |
| 4,883,009 | A | 11/1989 | Haselbeerger et al. |
| 4,890,924 | A | 1/1990 | Beckstein |
| 4,903,624 | A | 2/1990 | Card et al. |
| 4,903,625 | A | 2/1990 | Card et al. |
| 4,981,091 | A | 1/1991 | Taylor et al. |
| 4,991,523 | A | 2/1991 | Ingram |
| 5,005,498 | A | 4/1991 | Taylor et al. |
| 5,035,030 | A | 7/1991 | Pellari |
| 5,040,473 | A | 8/1991 | Zesch et al. |
| 5,058,518 | A | 10/1991 | Card et al. |
| 5,080,028 | A | 1/1992 | Ingram |
| 5,143,003 | A | 9/1992 | Dedmon |
| 5,165,352 | A | 11/1992 | Ingram |
| 5,205,233 | A | 4/1993 | Ingram |
| 5,224,434 | A | 7/1993 | Card et al. |
| 5,267,520 | A | 12/1993 | Ingram |
| 5,383,415 | A | 1/1995 | Padgett, III |
| 5,392,723 | A | 2/1995 | Kaju |
| 5,416,593 | A | 5/1995 | Cercruysse |
| 5,461,996 | A | 10/1995 | Kaju |
| 5,480,085 | A | 1/1996 | Smithe et al. |
| 5,484,639 | A | 1/1996 | Woodall et al. |
| 5,491,372 | A | 2/1996 | Erhart |
| 5,499,588 | A | 3/1996 | Card et al. |
| 5,513,586 | A | 5/1996 | Neely et al. |
| 5,526,760 | A | 6/1996 | Ok |
| 5,544,605 | A | 8/1996 | Frost |
| 5,549,064 | A | 8/1996 | Padgett, III |
| 5,557,154 | A | 9/1996 | Erhart |
| 5,562,056 | A | 10/1996 | Christman, Jr. |
| 5,566,630 | A | 10/1996 | Burgess et al. |
| 5,588,383 | A | 12/1996 | Davis |
| 5,622,126 | A | 4/1997 | Card et al. |
| 5,706,744 | A | 1/1998 | Card et al. |
| 5,706,745 | A | 1/1998 | Neely et al. |
| 5,738,030 | A | 4/1998 | Ok |
| 5,743,200 | A | 4/1998 | Miller et al. |
| 5,743,201 | A | 4/1998 | Card et al. |
| 5,794,551 | A | 8/1998 | Morrison et al. |
| 5,809,917 | A | 9/1998 | McGowan et al. |
| 5,896,821 | A | 4/1999 | Neely et al. |
| 5,979,344 | A | 11/1999 | Christman, Jr. |
| 5,989,368 | A | 11/1999 | Tillander et al. |
| 6,009,818 | A | 1/2000 | Card et al. |
| 6,213,036 | B1 | 4/2001 | Slattery |
| 6,244,203 | B1 | 6/2001 | Morgante et al. |
| 6,263,811 | B1 | 7/2001 | Crossley |
| 6,729,254 | B2 | 5/2004 | Mamiya |
| 6,776,109 | B2 | 8/2004 | Segars et al. |
| 6,782,838 | B1 | 8/2004 | Segars |
| 6,807,917 | B1 | 10/2004 | Christman et al. |
| 6,834,601 | B2 | 12/2004 | Card et al. |
| 6,834,602 | B1 | 12/2004 | Hall |
| 6,902,789 | B2 | 6/2005 | Funasako |
| 7,216,598 | B1 | 5/2007 | Christman, Jr. |
| 7,347,151 | B1 | 3/2008 | Johnston et al. |
| 7,426,895 | B2 | 9/2008 | Smith et al. |
| 7,490,566 | B2 | 2/2009 | Hall |
| 7,634,326 | B2 | 12/2009 | Christman, Jr. et al. |
| 7,717,051 | B1 | 5/2010 | Hall et al. |
| 7,814,850 | B2 | 10/2010 | Bearden |
| 7,946,233 | B2 | 5/2011 | Hall et al. |
| 8,042,479 | B2 | 10/2011 | Mori |
| 8,096,247 | B2 | 1/2012 | Monroe et al. |
| 8,141,506 | B2 | 3/2012 | Hall et al. |
| 8,240,263 | B1 | 8/2012 | Frost et al. |
| 8,347,800 | B1 | 1/2013 | Machell-Archer et al. |
| 8,359,989 | B2 | 1/2013 | Hall et al. |
| 8,443,743 | B2 | 5/2013 | Christman, Jr. |
| 8,695,519 | B2 | 4/2014 | Bearden |
| 8,776,703 | B2 | 7/2014 | Hall et al. |
| 9,051,672 | B2 | 6/2015 | Bearden |
| 2006/0048690 | A1 | 3/2006 | Whitten et al. |
| 2009/0260554 | A1 | 10/2009 | Hall et al. |
| 2010/0064954 | A1 | 3/2010 | Hall et al. |
| 2012/0222606 | A1* | 9/2012 | Bearden ..... 112/475.23 |

* cited by examiner

BACKING MATERIAL SHIFTER FOR TUFTING MACHINE

CROSS REFERENCE TO RELATED APPLICATIONS

The present Patent Application is a formalization of previously filed, U.S. Provisional Patent Application Ser. No. 61/977,292, filed Apr. 9, 2014 by the inventors named in the present Application. This Patent Application claims the benefit of the filing date of this cited Provisional Patent Application according to the statutes and rules governing provisional patent applications, particularly 35 U.S.C. §119(e), and 37 C.F.R. §§1.78(a)(3) and 1.78(a)(4). The specification and drawings of the Provisional Patent Application referenced above is specifically incorporated herein by reference as if set forth in their entirety.

FIELD OF THE INVENTION

The present invention generally relates to systems and methods for forming tufted articles, and in particular to a system and method for controlling the movement of a backing material, including shifting of the backing material transversely, as the backing material passes through a tufting machine for the formation of tufts therein.

BACKGROUND OF THE INVENTION

Conventional tufting machines for use in the formation of carpets and other tufted articles typically can include one or more needle bars carrying a series of spaced needles, with the needle bars being driven in a vertically reciprocated fashion by operation of a main drive shaft of the tufting machine so that the needles are reciprocated into and out of a backing material being fed through the tufting machine. Yarn feed mechanisms feed yarns to each of the needles of the needle bar or needle bars, with the yarns being carried into the backing material with the penetration of the needles through the backing material, whereupon the needles are engaged by loop pile loopers, cut pile hooks, or other gauge parts for forming a series of loop and/or cut pile tufts of yarns in the backing material. The backing material further generally will be fed through the tufting machine by a series of backing feed rolls, which typically include elongated spiked rolls engaging and feeding the backing material through the tufting machine.

In the past, it has been known to shift the backing feed rolls transversely to provide for desired tufted effects. However, due to the size of conventional backing feed rolls, which can, for example, extend across the width of the tufting machine, it can be difficult to accurately control the shifting of the backing feed rolls. In addition, due to their size, it also generally is necessary to support the backing feed rolls at spaced locations along the length of the backing feed rolls extending across the tufting machine to resist deflection of the backing feed rolls. For example, a series of brackets or saddles can be used to support the backing feed rolls while allowing for the sliding of the backing feed rolls thereacross to thus enable the lateral shifting movement of the backing feed rolls. Such shifting movements can subject these saddles or brackets to significant wear due to the movement of the backing feed rolls thereacross, often causing the saddles or support brackets to quickly wear out, requiring their replacement.

Accordingly, it can be seen that a need exists for a system and method for controlling the shifting of the backing material as it is fed through a tufting machine, which addresses the foregoing and other related and unrelated problems in the art.

SUMMARY OF THE INVENTION

Briefly described, the present invention generally relates to a backing material shift system and method for controlling the feeding and transverse shifting of a backing material moving through a tufting zone of a tufting machine for the production of tufted articles, such as carpets, rugs, artificial turf, and/or other tufted products, including the formation of various patterned tufted articles. The backing material shift system according to the principles of the present invention can be mounted on the tufting machine and can be linked to a control system for the tufting machine, which monitors and controls the operative elements of the tufting machine. The tufting machine further generally will include at least one or more needle bars carrying a series of spaced needles therealong, and driven along a vertically reciprocating movement or stroke by the main drive system of the tufting machine. As the needles of the one or more needle bars are reciprocated vertically, the needles carry a series of yarns into the backing material passing through the tufting zone of the tufting machine for the formation of tufts of yarns in the backing material.

The tufting machine can include a single needle bar having one or more rows of substantially inline needles, or can include a staggered needle bar having at least two spaced rows of needles separated by a desired stagger. It will be understood by those skilled in the art that the tufting machine also can include multiple needle bars, each carrying one or more in-line or staggered row(s) of needles, with the needles of the needle bars being arranged at a predetermined stagger and/or longitudinal spacing. Still further, the one or more needle bars can be shiftable in direction transverse to the longitudinal path of travel of the backing material through the tufting zone under control of a needle bar shift mechanism, as needed to provide various pattern effects.

The backing material shift system will control the feeding and shifting movement of the backing material through the tufting zone, and generally can include a frame that supports a first, front or upstream backing feed roll assembly and a second, rear or downstream backing feed roll assembly along the upstream and downstream sides of the tufting zone. The upstream and downstream backing feed roll assemblies each can include multiple backing feed rolls connected in series along the upstream and downstream sides of the tufting zone, such backing feed roll generally including an elongated body of a reduced length that is substantially less than the width of the tufting machine and having a series of spikes or other, similar gripping surface applied thereabout, and with the opposite ends of each backing feed roll received within stabilizing blocks or supports for rotatably supporting the backing feed rolls along the frame of the backing material shift system. Each of the upstream and downstream backing feed roll assemblies further will be connected to one or more drive motors for controlling rotation of the backing feed rolls for controlling feeding of the backing material through the tufting zone.

In addition, each of the roll stabilizing blocks of the upstream and downstream backing feed roll assemblies can be connected in series by laterally extending frame members, or lateral supports mounted therebetween. A series of bearing assemblies, which can include linear guide bearings or other, similar bearing assemblies, will be mounted to the lateral supports at spaced locations across the width of the tufting machine so as to slidably support the upstream and downstream backing feed roll assemblies on the frame of the tufting machine. The opposite or proximal and distal ends of the upstream and downstream backing feed roll assemblies generally can be linked/connected together by shifter shuttle assemblies. Each of the shifter shuttle assemblies generally will include rail mounts that can have front and rear or upstream and downstream vertical bearing supports mounted thereto, and which are connected to end support brackets of the upstream and downstream backing feed roll assemblies, and laterally extending shuttle plates mounted to the rail mounts. A series of rails or cross members also can extend between the shifter shuttle assemblies along the length of the backing material shifter frame, with the shuttle plates having a series of rail support assemblies slidably mounted to the rails or cross members, such as by linear bearings or similar bearing assemblies, for supporting the frame of the backing shifter system from the frame of the tufting machine and enabling the transverse or laterally shifting movement of the backing feed rolls.

The tufting machine further can include one or more yarn feed mechanisms mounted along the front or upstream and/or rear or downstream sides of the tufting zone. The yarn feed mechanisms can include various yarn feed systems and/or pattern attachments, including single end, double end, scroll, roll, and standard yarn feed devices or attachments, which can be controlled by the tufting machine control system for feeding yarns to the needles in accordance with programmed pattern instructions. As the needles penetrate the backing material, they will be engaged by a series of gauge parts, such as cut pile hooks, loop pile loopers, level cut loop loopers, etc., so as to form cut and/or loop pile tufts within the backing material.

As the backing material is fed along its longitudinal path of travel through the tufting zone of the tufting machine, the backing material further can be shifted transversely or laterally with respect to the tufting zone by the operation of at least one backing feed shifter connected to the frame of the backing material shift system. The backing feed shift mechanism can include a cam shifter or electronic shift mechanism that will operate to shift the upstream and downstream backing feed roll assemblies across the tufting zone in accordance with a programmed or desired shift profile for the backing feed, such as to provide for various patterned or tufting effects. For example, the backing material can be shifted in conjunction with the shifting of the one or more needle bars of the tufting machine needed to provide for varying length shifts or jumps of the needles.

Various objects, features and advantages of the present invention will become apparent to those skilled in the art upon a review of the following description, when taken in conjunction with the accompanying drawings.

Figure 1A:
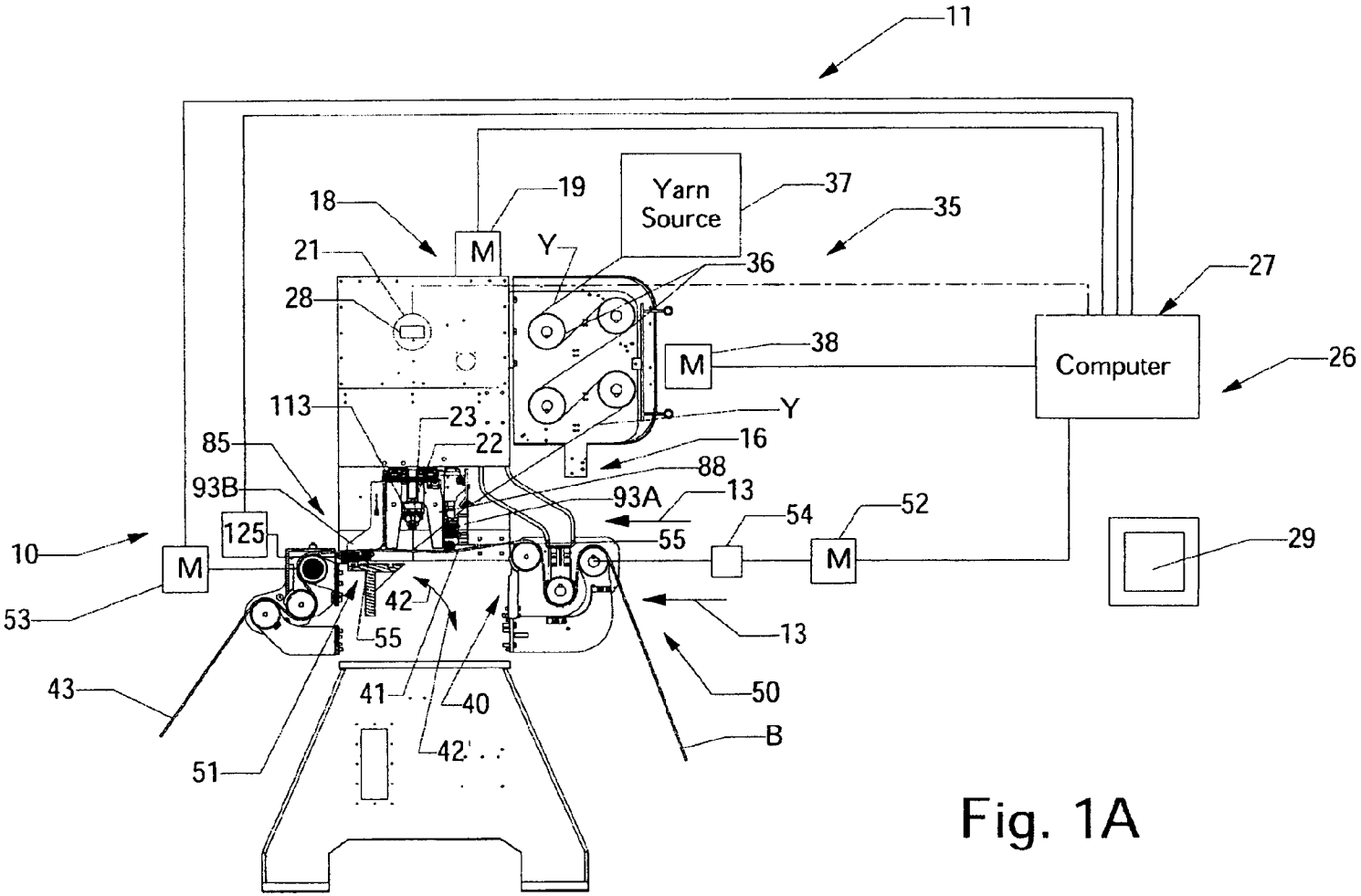
FIG. 1A is a side elevational view schematically illustrating a tufting machine utilizing the backing material shift system according to one embodiment of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Figure 1B:
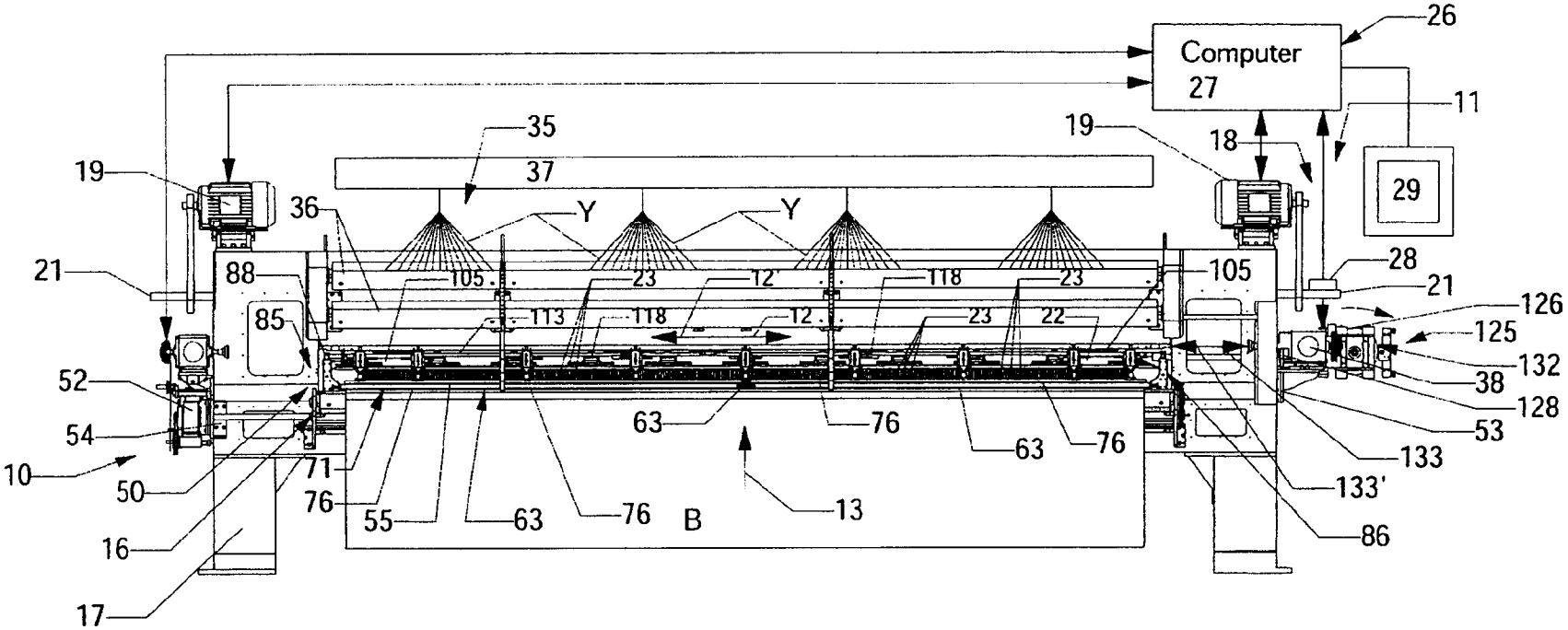
FIG. 1B is an end view of the tufting machine with the backing material shift system according to one embodiment of the present invention.

Referring now to the drawings in greater detail in which like numerals indicate like parts throughout the several views, as illustrated in FIGS. 1A-1B, the present invention is directed to a backing material shift system 10 and method for controlling movement of a backing material B through the tufting zone T of a tufting machine 11, including control of the movement or shifting of the backing material in a lateral or transverse direction with respect to the tufting zone, such as indicated at arrows 12 and 12' and FIG. 1B, as the backing material is fed through the tufting zone along a longitudinal path of travel indicated by arrow 13. In one embodiment, the backing material shift system 10 and method according to the principles of the present invention is designed to enable enhanced control of the shifting the backing material as needed, while the backing material is fed through the tufting zone, to provide for the formation of various programmed or desired tufted pattern effects in the backing material, including assisting in the placement of tufts of yarns during the shifting of the needles of the tufting machine, and/or provide the resultant tufted articles, such as carpets, rugs, artificial tuft, other, similar tufted products, with various other patterned features, such as positive stitch placement type effects.

As indicated in FIGS. 1A-1B, the backing material shift system 10 can be mounted to or included as part of the tufting machine 11, and will include a supporting framework or frame 16 slidably mounted along the frame 17 of the tufting machine, generally in a position adjacent or straddling the tufting zone T of the tufting machine. The tufting machine 11 will include a main drive 18, including one or more motors 19 driving a main drive shaft 21 so as to drive at least one or more needle bars 22 along a reciprocating movement or stroke. In one embodiment, the tufting machine can include a single inline needle bar with a series of needles 23 arranged in spaced series in a substantially-inline alignment along the length of the needle bar, or can include a staggered needle bar having multiple rows of spaced needles, with the rows of needles being spaced apart in the direction of movement of the backing feed, as indicated by arrow 13, by a desired stagger or longitudinal spacing. In still other embodiments, the tufting machine can include multiple needle bars, with the needles arranged therealong in substantially inline and/or in substantially staggered alignments, as will be understood by those skilled in the art. For example, a pair of needle bars can be used with each carrying a row of needles that are separated or offset by desired stagger.

The tufting zone T thus is defined within the space below the needles 23 carried by the one or more needle bars 22 and through which the backing material B is passed as it is moved along its longitudinal path of travel in the direction of arrow 13. As the one or more needle bars are reciprocally driven by the main drive shaft 21 of the tufting machine 11, the needles 23 of the one or more needle bars 22 are reciprocated or moved along a stroke between a raised position out of engagement with the backing material and a lowered position penetrating the backing material for inserting the series of tufts of yarns wide therein.

The tufting machine further generally can include a control system 26, such as a "Command Performance™" tufting machine computer control system as manufactured by Card-Monroe Corp. The control system 26 generally can include a computer controller or processor 27 that can be programed with pattern information instructions performing various desired tufted patterns, or can be programmed with additional information for controlling the tufting operation of the tufting machine. The control system will be in communication with and can be programmed to control various operative features, elements and functions of the tufting machine, including monitoring and controlling the motor(s) 19 driving the main drive shaft 21 of the tufting machine. In one embodiment, an encoder, resolver, or other similar monitoring device 28 also can be mounted on the main drive shaft for detecting and providing feedback information regarding the position of the main drive shaft during its operation, while in other embodiments, the motor(s) can provide such position feedback information. Additionally, the control system 26 can include a user interface 29, such as a touch screen, keyboard and mouse, tablet or other, similar input device to enable operator input in programming the control system. The control system further can be connected to a separate pattern design center or system server for receiving pattern instructions, or can include pattern design functionality or capability to enable the creation and programming of patterns directly therein.

In addition, the tufting machine also can include a needle bar shift mechanism 31 (FIG. 1B) for shifting the one or more needle bars 22 in a direction transverse to the longitudinal path of movement of the backing material B through the tufting zone T. The shift mechanism 31 can include cam or electronic shift control mechanisms such as "Smart Step™" shifter control mechanism as manufactured by Card-Monroe Corp., and can be linked to the control system of the tufting machine for controlling the transverse shifting movement of the one or more needle bars.

As further indicated in FIGS. 1A-1B, a plurality of yarns Y will be fed to each of the needles 23 by one or more yarn feed mechanisms 35. The yarn feed mechanism(s) 35 can include one or more standard or conventional yarn feed mechanisms mounted along the upstream and/or downstream sides of the tufting machine. For example, in one embodiment such as indicated in FIGS. 1A-1B, the yarn feed mechanism 35 can include a series of yarn feed rolls 36 that receive a plurality of yarns Y from a yarn supply 37, such as a creel, beam or other yarn supply mechanism, and with the yarn feed rolls 36 being driven by one or more motors 38 under control of the control system 26 of the tufting machine to feed the yarns Y to the needles 23 as needed to form various pattern effects. Alternatively, the one or more yarn feed mechanism(s) can include various yarn feed pattern attachments or devices, such as a scrolled, rolled, single and/or double end yarn feed attachments or devices, for example an Infinity™, Infinity IIE™ or Yarntronics™ pattern attachments or yarn feed systems as manufactured Card-Monroe Corp., for controlling the feeding of yarns to selected groups or selected ones of the needles, including varying the yarn feed in accordance with pattern instructions as needed to form a desired pattern of tufts of yarns in the backing material. Also, while a single yarn feed mechanism is shown on one side of the tufting machine, it will be understood that additional yarn feed mechanisms can be mounted on one or both sides of the tufting machine.

As the needles penetrate the backing material, they generally will be engaged by a series of gauge parts 40 (FIG. 1B), such as loop pile loopers, cut pile hooks, level-cut-loop loopers or other, similar gauge parts, as will be understood by those skilled in the art. The gauge parts will be reciprocated into the engagement with the needles as the needles penetrate the backing material and will pick and pull loops of yarns therefrom. For example, as shown in FIG. 1A, one embodiment, a series of loopers 41 can be reciprocated in the direction of arrows 42 and 42' into engagement with the needles 23 as the needles penetrate the backing material, striking the needles and pulling loops of yarns Y therefrom in order to form a series of tufts 43 of yarns in the backing material B. While loopers 41 are illustrated in use in one embodiment of the gauge parts 40, it will be understood by those skilled in the art that other types of gauge parts, including cut pile hooks, level-cut-loop loopers, cut/loop clips and/or other gauge parts and/or combinations thereof also can be provided. In addition, while the gauge parts are shown in one example embodiment in FIG. 1A as being arranged on or along an upstream side of the tufting zone, it further will be understood that additional sets of gauge parts, including additional loop pile loopers, cut pile hooks, little cut loop loopers, cut loop clips, etc., also can be mounted along the downstream side of the tufting zone, in addition to, or in place of, the upstream gauge parts. For example, a "velva-loop" type arrangement can be provided, with loopers mounted on an upstream side and a series of cut pile hooks mounted along the downstream side of the tufting zone, such as disclosed and claimed in U.S. Pat. No. 6,834,602, the disclosure which is incorporated by reference as if set forth fully herein.

As illustrated in FIGS. 1B-2B, the frame 16 of the backing material shift system 10 will be shiftably or slidably mounted to the frame 17 of the tufting machine 11 in a position so as to be movable laterally across the tufting zone T, and generally can include first and second or front, upstream and rear, downstream backing feed roll assemblies 50 and 51 linked together by the frame 16 of the backing materials shift system so as to be movable as a substantially unitary structure. In addition, backing feed drive motors 52 and 53 (FIG. 1A) generally can be linked to the upstream and downstream backing feed roll assemblies for driving the rotation of the backing feed rolls 55 thereof for controlling the feeding of the backing material B along its longitudinal path of travel 13 through the tufting zone. The drive motors generally will be linked to and controlled by the control system 26, and can include various types of motors, such as servomotors, stepper motors, vector motors, AC motors, DC motors and/or other types of actuators or drive systems. In addition, gear boxes 54 also can be used for assisting in the driving of the backing feed rolls by the drive motors 52 and/or 53 to provide desired gear reduction and/or drive ratios as needed. Still further, one or more drive motors can be used for driving the backing feed rolls of the upstream and downstream backing feed roll assemblies, including use of a single motor driving the backing feed rolls of the upstream or downstream backing feed roll assemblies and being connected to the backing feed rolls of the other upstream or downstream backing feed roll assembly such as by a belt drive or other linkage, for driving the other assembly. The driving of the backing feed rolls will be controlled in order to maintain tension control to the backing material as it is fed through the tufting zone including providing jumps or advancements of the backing material as needed to form desired pattern effects. An example of a drive arrangement for the backing feed rolls can be found in U.S. Pat. No. 8,141,506, assigned to Card-Monroe Corp., the disclosure of which is incorporated by reference as if set forth fully herein.

As further illustrated in FIGS. 2A-3B, the upstream and downstream backing feed roll assemblies each will include a series of backing feed rolls 55 that are of a reduced length. For example, in many conventional tufting machines, the backing feed rolls typically can be of a length sufficient to span or extend across the tufting zone. The backing feed rolls 55 of each of the upstream and downstream backing feed roll assemblies thus can be of a reduced length that is substantially less than the full width of the tufting zone; with the upstream and downstream backing feed roll assemblies including multiple backing feed rolls of a desired length or size that are connected in series across the tufting zone. For example, depending upon the width of the tufting machine/tufting zone, at least two or more reduced length backing feed rolls can be provided. By way of further example, in one embodiment shown in FIG. 2A, up to 8 backing feed rolls are mounted in a series, with each of the backing feed rolls generally being of a substantially equivalent length and/or size, though it will be understood that other, varying numbers and sizes of rolls can be used. As a result, the weight of the backing feed rolls can be substantially reduced, in addition to providing a reduction in their length.

Figure 3A:
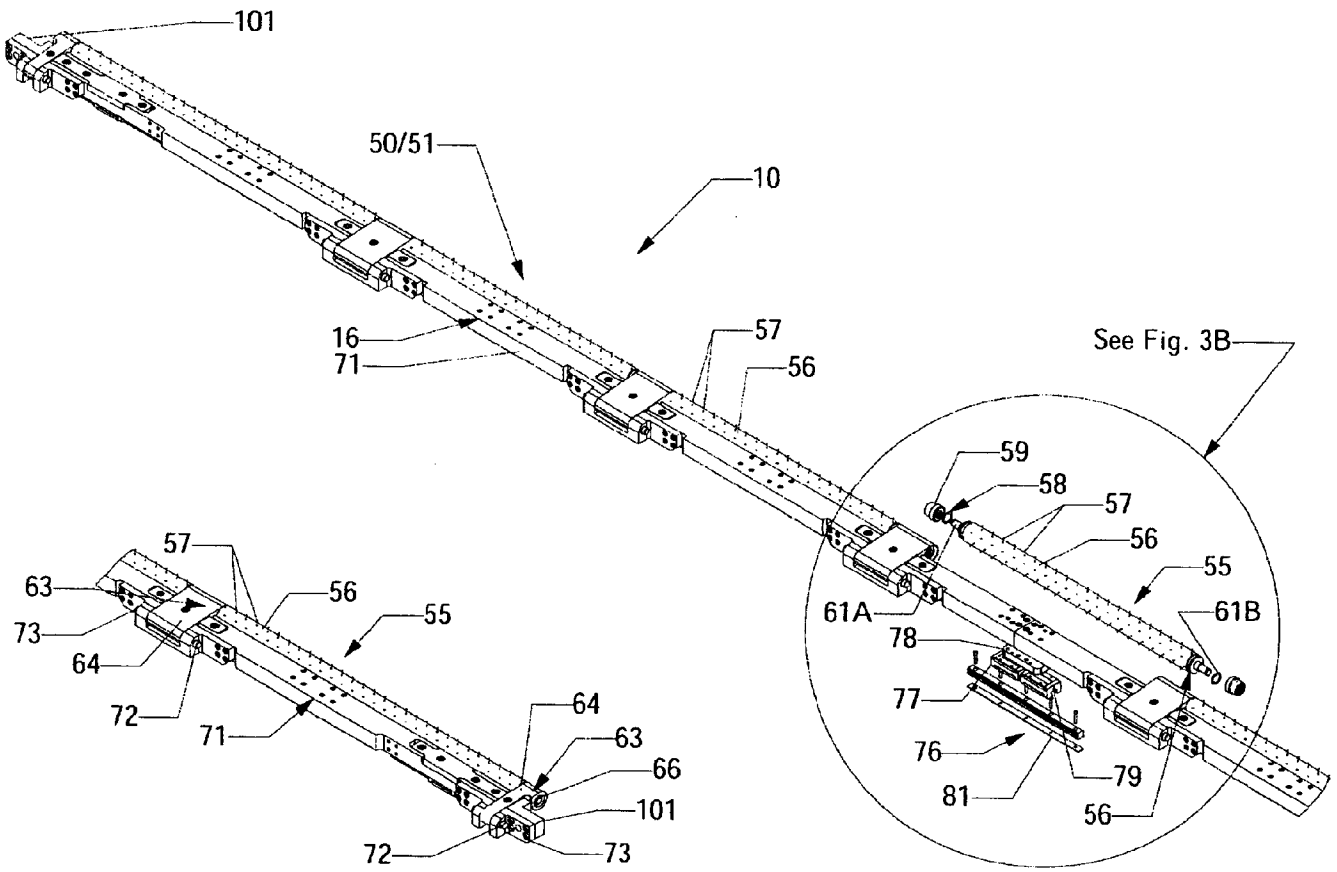
FIG. 3A is a perspective illustration of one of the backing feed roll assemblies of the backing material shift system of FIGS. 2A-2B.
Figure 3B:
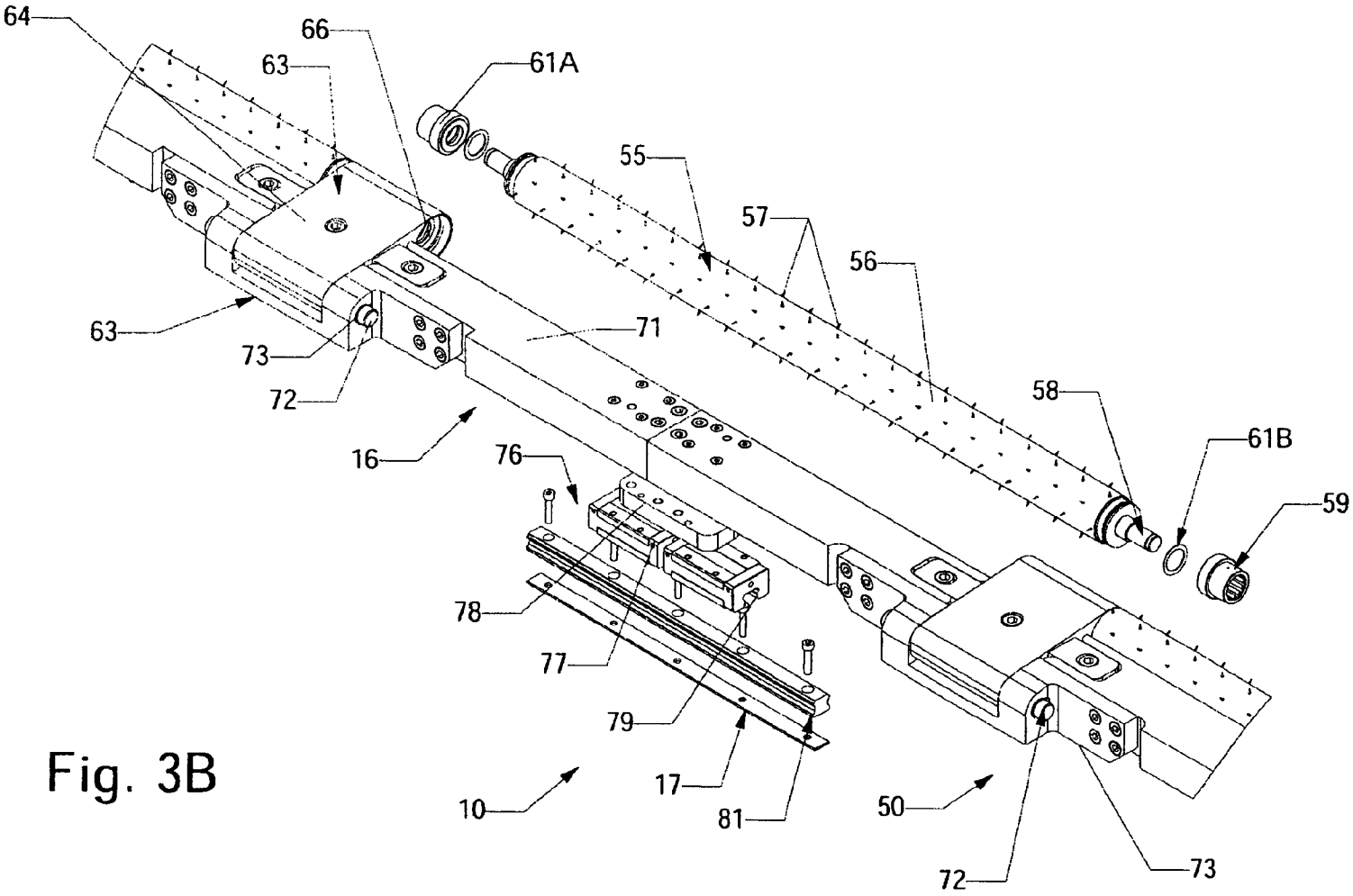
FIG. 3B is a perspective illustration of a backing feed roll, illustrating the interconnection of the backing feed rolls along the framework of the backing feed assembly of FIGS. 2A-3A.

As illustrated in FIGS. 3A and 3B, each of the backing feed rolls 55 generally will include cylindrical body 56 having a series of spikes 57 applied thereabout, or can otherwise include a tacky or other gripping surface sufficient to enable positive engagement, gripping and pulling of the backing material through the tufting zone. An axle or drive shaft 58 generally can be extended through the body 56 of each backing feed roll, with the ends 61A/61B of the drive shaft of each backing feed roll generally projecting from the body and with thrust bearings 59 being received between the ends of adjacent backing feed rolls 55, as indicated in FIGS. 3A-3B, for connecting each of the backing feed rolls in series to enable both rotation and lateral shifting movement thereof.

As further illustrated in FIGS. 3A and 3B, the opposite ends 61A/61B of the drive shafts 58 of each of the backing feed rolls 55 for the upstream and downstream backing feed roll assemblies each will be received within roll stabilizing blocks 63 with the ends of each of the backing feed roll drive shafts extending therethrough and being connected by their thrust bearings 59 in a driving relationship with the ends of the drive shafts of adjacent backing feed rolls. Each of the roll stabilizing blocks 63 can include a body 64 having a channel or passage 66 along one side, through which the thrust bearings 59 and the ends 61A/61B of the backing feed roll drive shafts 58 are received, so as to thus provide support and stability to each end of the reduced length backing feed rolls 55, while still enabling the rotary movement of the backing feed rolls as needed for driving or feeding the backing feed material through the tufting zone, as well as helping provide enhanced control of the backing feed rolls during transverse shifting thereof.

Each of the roll stabilizing blocks can be connected in series by laterally extending frame members or lateral supports 71. In one embodiment, as illustrated in FIG. 3B, the roll stabilizing blocks 63 can be pivotally connected or attached by pivot pins 72 to pivoting support brackets 73 mounted to each of the lateral supports 71, with the body 64 of each roll stabilizing block 63 extending across its lateral support 71. As a result, the upstream and downstream backing feed roll assemblies can be permitted to move or adjust vertically as needed to adjust the elevation of the backing feed rolls. Alternatively, the roll stabilizing brackets along the upstream or downstream backing feed roll assemblies, or both, can be substantially fixedly mounted to the lateral supports 71.

In addition, as further illustrated in FIGS. 3A-3B, sliding bearing assemblies 76 can be mounted to the lateral supports 71, at spaced locations therealong, for slidably supporting the upstream and downstream backing feed roll assemblies along the frame of the tufting machine. In one embodiment, the sliding bearing assemblies 76 can be mounted at intermediate positions between the roll stabilizing blocks 63, though additional arrangements or locations of the sliding bearing assemblies also can be used. Each of the sliding bearing assemblies 76 further can include a linear bearing having linear guide blocks 77 mounted to their lateral support 71 by mounting plates 78, or other similar mounting arrangements, and which include a series of internal bearings mounted along a guide recess or passage 79. A track or rail 81 will be mounted along the frame of the tufting machine beneath each of the bearing guides, with each track being received within the recess 79 of its associated/engaging bearing guide for directing the sliding movement of the bearing guides, and thus the upstream and downstream backing feed roll assemblies, in a transverse or lateral direction across the tufting zone.

Figure 2A:
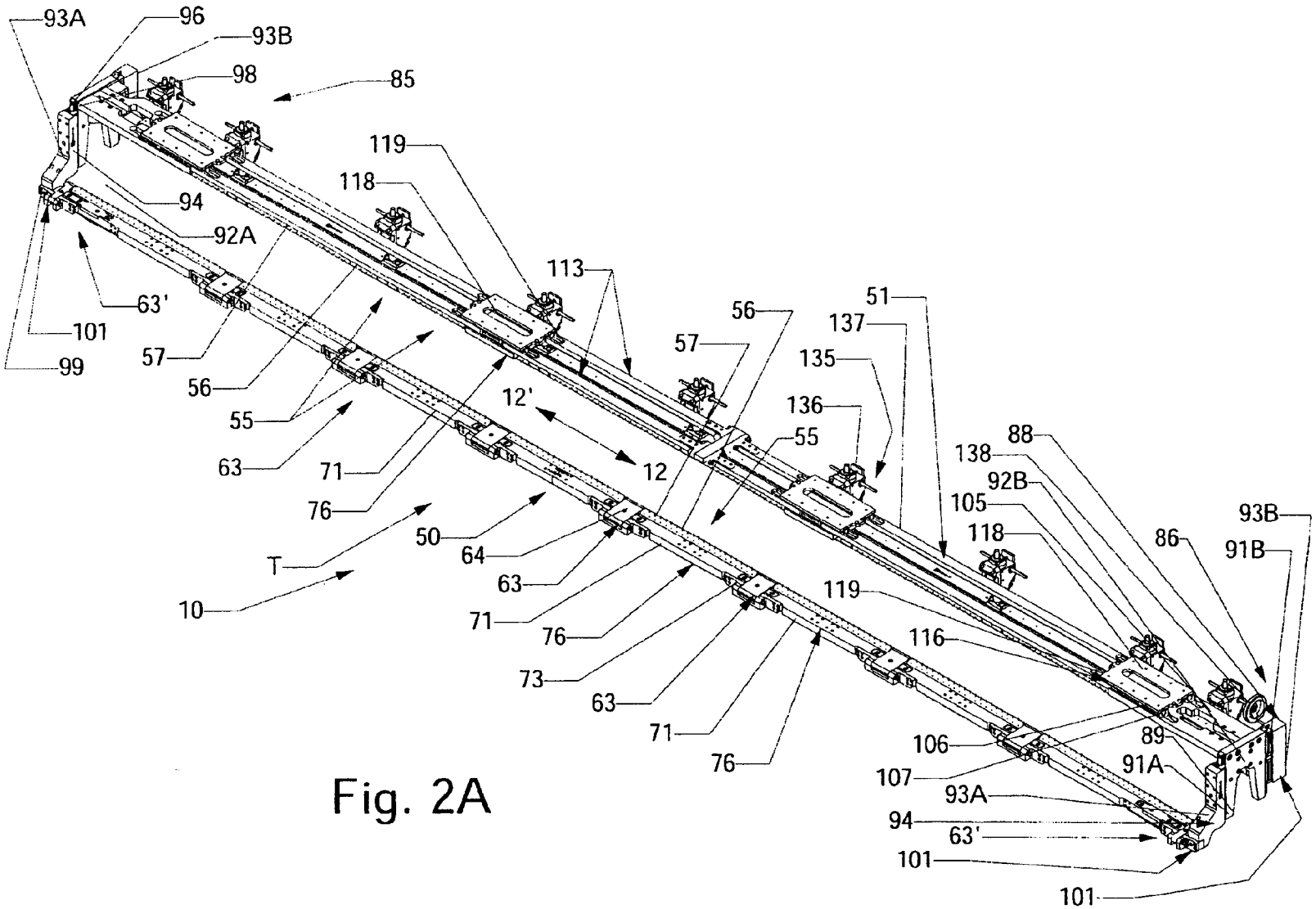
FIGS. 2A-2B are perspective illustrations of one embodiment of the backing material shift system according to the principles of the present invention.
Figure 2B:
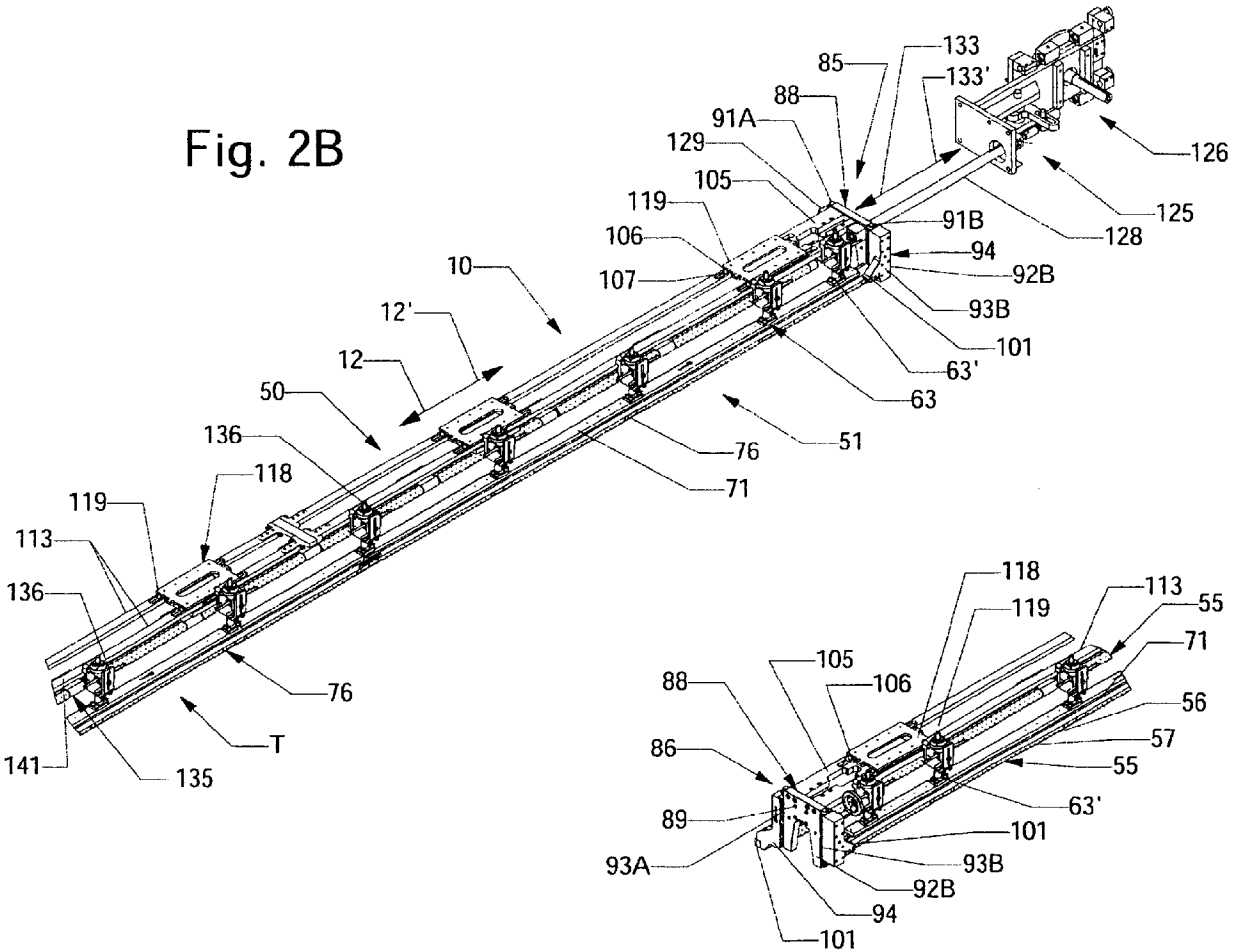

As further illustrated in FIGS. 2A-2B, the frame 16 of the backing material shift system 10 further can include shifter shuttle assemblies 85 and 86 mounted at the drive and non-drive ends/sides of the tufting machine between the upstream and downstream backing feed roll assemblies 50 and 51. The shifter shuttle assemblies 85 and 86 thus can connect the upstream and downstream backing feed roll assemblies together. In one embodiment, the connection of the upstream and downstream backing feed roll assemblies by the shifter shuttle assemblies 85 and 86 can define or provide a substantially rigid frame 16 that enables the backing material shift system to be shifted or moved transversely across the tufting zone as a substantially unitary assembly or system. Alternatively, one or both of the upstream and downstream backing feed roll assemblies further can be slidably mounted to the shifter shuttle assemblies at the drive and non-drive ends, slidably supporting the upstream and downstream backing roll assemblies for combined movement, while further enabling independent shifting movement of the upstream and/or downstream backing feed roll assemblies.

Figure 4A:
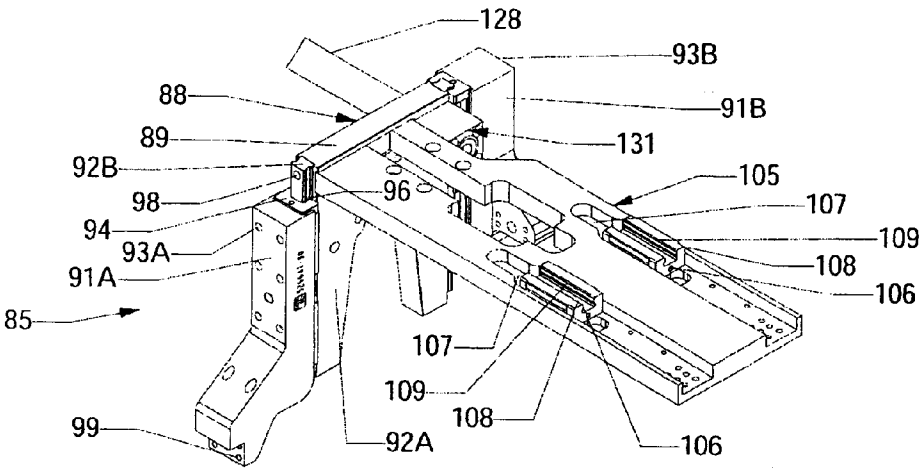
FIGS. 4A-4B are perspective illustrations of the shuttle assemblies supporting the drive and non-drive side ends of the upstream and downstream backing feed roll assemblies.
Figure 5B:
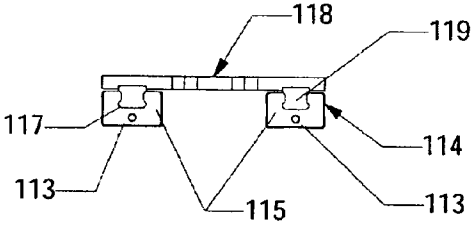
FIG. 5B is an end view of the support plate of FIG. 5A mounted on cross members or rails of the backing material shift system of FIGS. 2A-3B.
Figure 5A:
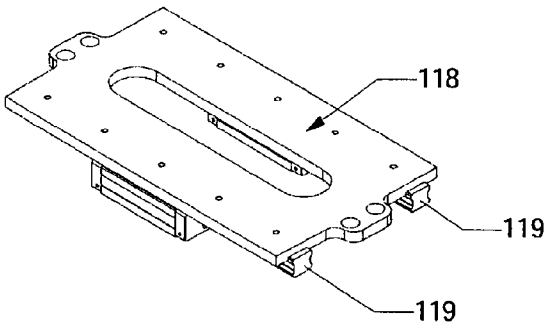
FIG. 5A is a perspective illustration of a sliding support plate for the backing material shift system of FIGS. 2A-3B.
Figure 4B:
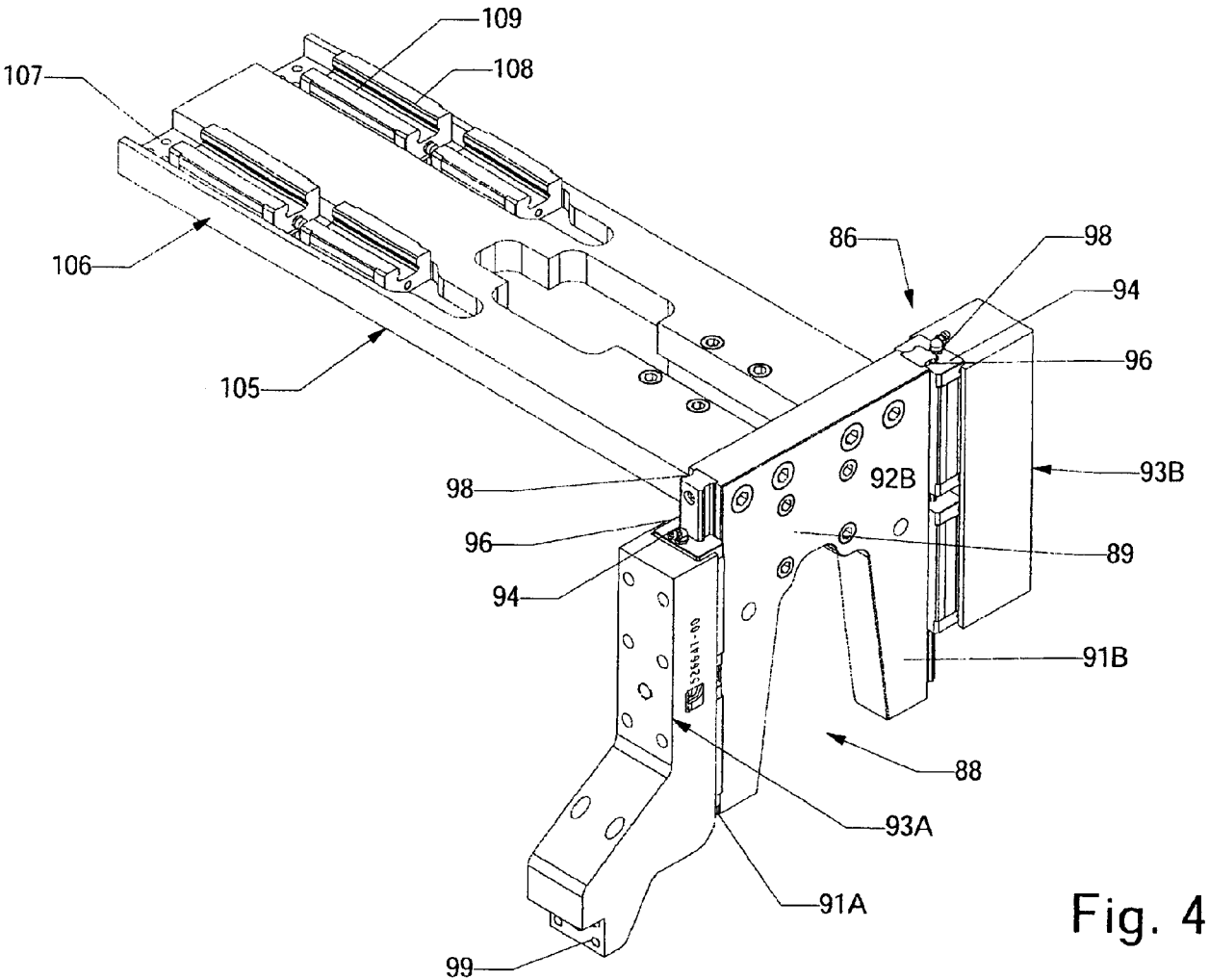

As illustrated in FIGS. 4A and 4B, the shifter shuttle assemblies 85 and 86 each generally can include a rail mount 88, including a vertically mounted body 89 having upstream and downstream edges 91A/91B and interior and exterior facing surfaces 92A and 92B. Front and rear vertical bearing supports 93A and 93B will be mounted to the upstream and downstream edges 91A and 91B of the body of each rail mount 88. The bearing supports 93A/93B can comprise linear bearings or other slidable bearing assemblies, each including an elongated guide 94 with a guide passage 96 defined therealong. The guide passage 96 can include a series of linear bearings mounted therealong, and will receive a corresponding guide track 98, which is mounted to the upstream or downstream side edge of the rail mount body, so as to enable vertical sliding movement of the vertical bearing supports 93A and 93B therealong. As illustrated in FIG. 2, each of the vertical bearing supports 93A and 93B further can be connected at their lower ends 99, along a proximal or opposite side thereof, to a support arm 101 connected to each of the endmost roll stabilizing blocks 63' of the upstream and downstream backing roll assemblies 51 and 52.

In addition, each of the shuttle shifter assemblies 85 and 86 further can include a laterally projecting shuttle plate 105 connected to the interior facing surface 92A of the body of each rail mount 88, as shown in FIGS. 2A, 2B, 4A and 4B. Each of the shuttle plates can include one or more bearing assemblies 106 mounted therealong. For example, as illustrated in FIGS. 4A and 4B, the bearing assemblies 106 can include linear bearings or other, similar bearing mechanisms, mounted within slots 107 formed in the upper surface of each shifter plate, with each bearing assembly 106, including a guide 108 mounted within one of the slots 107 and having a guide passage or recess 109 formed therealong, along which a series of bearings can be provided.

As further generally illustrated in FIG. 2A-2B, a series of transversely extending rails or cross members 113 will extend along the length of the backing material shift system 10 between the shifter shuttle assemblies 85 and 86. Each of the rails or cross members 113 generally will be mounted at their opposite ends to the interior facing surfaces 92A of the body of each of the rail mounts of the shifter shuttle assemblies. The cross members also can include a series of upper bearing assemblies, such as linear bearing assemblies 114, including guides 115 mounted along an upper facing surface 116 of each rail.

As also illustrated in FIGS. 2A-2B, a series of shift support plates 118 can be provided at spaced locations along the length of the cross members and above the shuttle plates 105 of each of the shifter shuttle assemblies 85/86. The shift support plates 118 generally can be mounted to the frame of the tufting machine, and can include a series of guide tracks 119 mounted along a lower or underside surface thereof, and which guide tracks 119 are adapted to be received within the guide recesses 109 and 117 of the guides 108 and 115 of the upper bearing assemblies 106 and 114 mounted along the shuttle plates 105 and the cross members 113, respectively. The shift support plates thus slidably support the cross members or rails from the frame of the tufting machine, in a manner enabling the lateral or transverse shifting movement thereof.

Figures 6A, 6B:
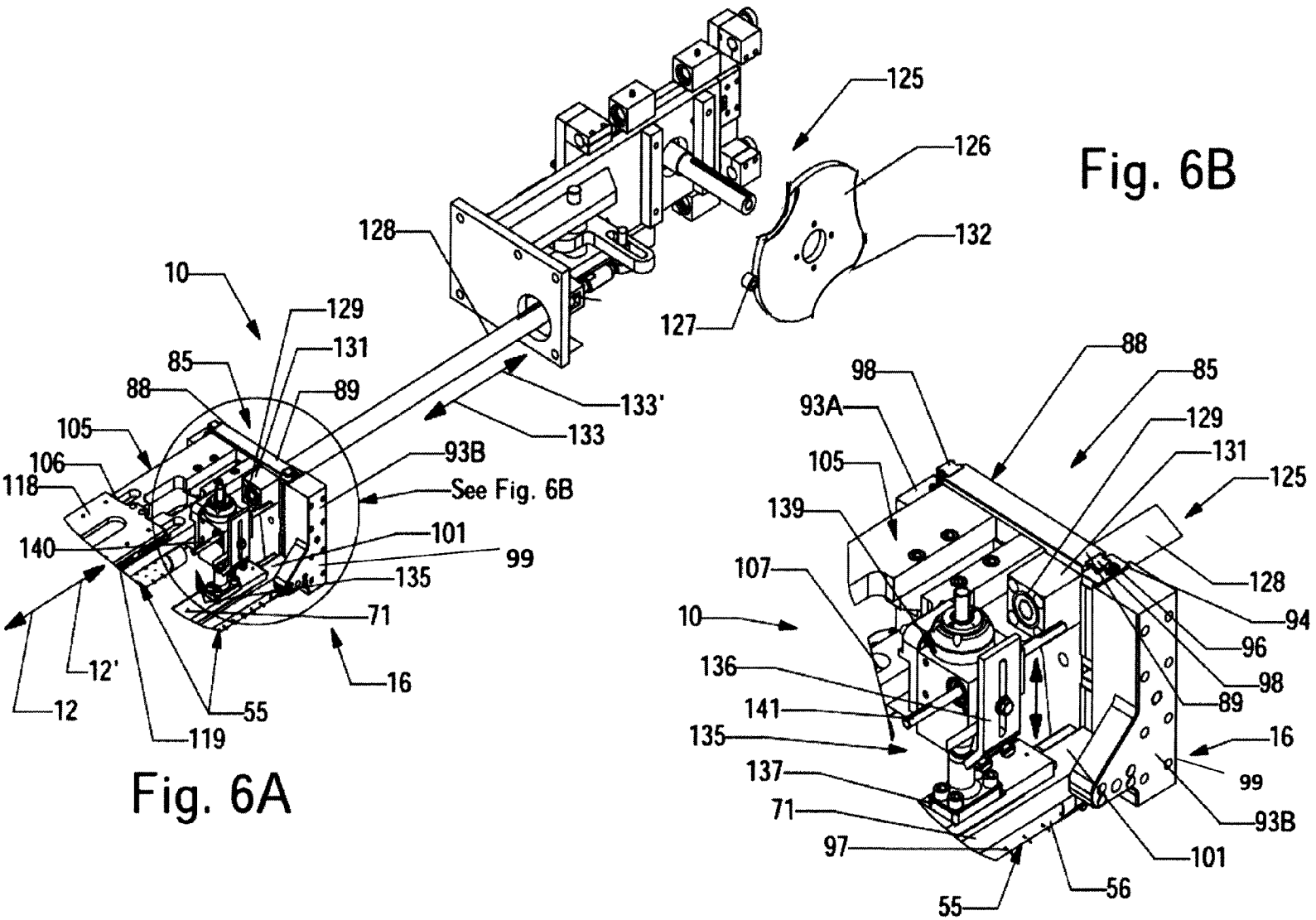
FIGS. 6A-6B are perspective illustrations of the drive end of the backing material shift system of FIGS. 2A-2B.

As further illustrated in FIGS. 1B, 2B and 6A, the backing material shift system 10 of the present invention generally will include one or more backing feed shift mechanisms 125, which can be mounted on one or both sides of the tufting zone. In one embodiment, as shown in FIGS. 1B, and 6A, the backing feed shift mechanism 125 can include a cam shifter having a rotating cam 126, which is engaged by a cam roller 127, or similar cam follower that is biased into engagement therewith and is linked to and drives a laterally extending shift rod 128 that is connected to the frame 16 of the backing material shift system 10 along the drive side or end thereof. For example, as illustrated in FIG. 6A, the shift rod 128 can extend through and be connected to the end mount 88 of the drive side shuttle shifter assembly 85, with a distal end 129 of the drive rod being received and secured such as by bracket or bushing 131. Additional types of shifting mechanisms, such as electronic shifters, also can be used.

The backing feed shift mechanism 125 further can be connected to the control system of the tufting machine to provide feedback and/or for monitoring and control of the transverse shifting of the backing material. As the cam 126 is rotated, the movement of the cam follower/roller 127 along the profiled peripheral surface 132 of the cam causes the shift rod 128 to be driven in the direction of arrows 133/133' to cause the corresponding shifting movement of the backing material in the direction of arrows 12 and 12' as shown in FIG. 1B.

In addition, as shown in FIGS. 2B-6B, the backing material shift system 10 can further be provided with a positioning system 135 for adjusting the vertical position or elevation of the backing feed rolls 55. The positioning system, in one embodiment, can include a series of support brackets 136 mounted to at least one of the cross members or rails 113 of the backing material shift system at an upper end thereof, and to connectors or feet 137 at a lower end thereof. The connectors 137 can be mounted to the lateral supports 71 or roll stabilizing blocks of the backing material shift system frame 16, as shown in FIG. 6B, to link the frame to the positioning system 135. An adjustment mechanism 138, such as a crank (shown in FIG. 2A) or a motor, solenoid or other drive/actuating mechanism 139 (as shown in FIG. 6B) can be connected to a drive shaft 141 that extends transversely along the frame of the backing material shift system, through the support brackets 136. The adjustment mechanism can be engaged to cause the frame 16 of the backing material shift system 10, and thus the backing feed rolls 55, to be moved to a desired elevation with respect to the needles of the tufting machine. In one embodiment, both backing feed roll assemblies can be adjusted vertically as a unit, or, alternatively, the elevation of one of the backing feed roll assemblies, i.e., the second or downstream backing feed roll assembly, can be adjusted, while the backing feed rolls of the first or upstream backing feed roll assembly can be maintained substantially at their elevation, such as by the pivoting connection of their roll stabilizing blocks to their lateral supports.

In operation of the tufting machine, the backing material will be fed through the tufting zone T of the tufting machine 11 by the driven rotation of the backing feed rolls of the upstream and downstream backing feed roll assemblies. As the backing material proceeds through the tufting zone, the needles will be reciprocated into and out of the backing material for forming a series of tufts of yarns therein. In addition, the backing material can be shift transversely, in the direction of arrows 12 and 12' (FIG. 1B) by operation of the backing material shift mechanism 125. The backing material can be shifted in accordance with the programmed or desired shift profile, such as by use of a cam having a desired cam profile, as will be understood by those skilled in the art, either at substantially the same time as the backing material continues its movement through the tufting zone, or with the backing material being stopped, as needed. The shifting of the backing material can be used to provide for a variety of different pattern effects, including the creation of positive stitch placement type tufting effects, as well as to help ensure or facilitate the jumps or shifts of the needles to different areas of the backing material and/or for enabling varying shifts or jumps of the needles as needed.

The backing material shift system of the present invention further can provide additional points of support for the backing feed rolls, such as by reducing the overall length of the backing feed rolls and supporting the ends thereof, in order to provide for additional stability and greater support of the backing feed rolls during shifting. In addition, the supporting component can enable shifting of the backing feed rolls with the incidence of wear of such components being reduced.

It will be understood by those skilled in the art that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A system for controlling movement of a backing material through a tufting machine, comprising:

first and second backing feed roll assemblies, each comprising:

a plurality of backing feed rolls, each backing feed roll having spaced ends;

a plurality of roll stabilizing blocks positioned between and rotatably supporting ends of adjacent ones of the backing feed rolls;

sliding bearing assemblies arranged along the first and second backing feed roll assemblies and configured to slidably support the first and second backing feed roll assemblies;

wherein the backing feed rolls of at least one of the first or second backing feed roll assemblies have a length less than half of a width of the tufting machine and are coupled in series by the roll stabilizing blocks located therebetween;

a drive motor linked to the backing feed rolls of at least one of the first andier or second backing feed roll assemblies for driving rotation of the backing feed rolls to feed the backing material along a path of travel through the tufting machine;

at least one cross member slidably coupled to the tufting machine and connected to the first and second backing feed roll assemblies, the at least one cross member being movable transversely with respect to the path of travel of the backing material through the tufting machine for transversely shifting the first and second backing feed roll assemblies; and a backing material shifter in communication with and adapted to move at least one of the first and second backing feed roll assemblies transversely to control shifting of the backing material in a transverse direction with respect to its path of travel through the tufting machine.

2. The system of claim 1, wherein each of the first and second backing feed roll assemblies further comprises a series of lateral supports extending adjacent the backing feed rolls and connected to the roll stabilizing blocks therefor, and and further comprising shifter shuttle assemblies mounted adjacent opposite ends of the at least one cross member and connected to endmost ones of the roll stabilizing blocks of each of the first and second backing feed roll assemblies so as to define a framework supporting the backing feed rolls while enabling rotational and transverse shifting movement thereof.

3. The system of claim 2, further comprising a plurality of upper bearing assemblies mounted at spaced locations along the at least one cross member and configured to engage guide tracks mounted to the tufting machine for guiding the transverse shifting movement of the backing feed rolls.

4. The system of claim 3, wherein the upper bearing assemblies comprise linear bearings.

5. The system of claim 2, wherein the roll stabilizing blocks of at least the first backing feed roll assembly are pivotally mounted to their lateral supports to enable adjustment of an elevation of the backing feed rolls supported thereby.

6. The system of claim 2, wherein the backing feed rolls each comprise a body having a series of spikes thereabout and a drive shaft extending therethrough, and further comprise a series of bearings coupling ends of the drive shafts of adjacent ones of the backing feed rolls.

7. The system of claim 1, further comprising an adjustment mechanism linked to at least one of the first or second backing feed roll assemblies and to the tufting machine for adjusting an elevation of the backing feed rolls of at least one of the first or second backing feed roll assemblies.

8. The system of claim 1, further comprising thrust bearings connecting the ends of adjacent ones of the backing feed rolls to facilitate rotational and transverse shifting movement of the backing feed rolls.

9. A tufting machine, comprising:

a frame;

at least one needle bar having a plurality of needles mounted therealong;

a yarn feed mechanism feeding yarns to the needles;

first and second backing feed roll assemblies spaced from each other across a tufting zone for feeding a backing through the tufting zone, at least one of the first or second backing feed roll assemblies comprising a plurality of reduced length backing feed rolls connected in series across the tufting zone, each of the reduced length backing feed rolls having a length less than a width of the tufting zone;

a framework connecting the first and second backing feed assemblies and movably mounted along the frame so as to slidably couple the first and second backing feed assemblies to the frame of the tufting machine;

at least one backing feed motor coupled to and driving backing feed rolls of the first and second backing feed roll assemblies for moving the backing in a feed direction through the tufting zone; and a backing material shifter connected to the framework and operable for shifting the first and second backing feed roll assemblies in a transverse direction across the tufting zone.

10. The tufting machine of claim 9, wherein the framework connecting the first and second backing feed roll assemblies comprises a series of lateral supports mounted between roll support stabilizing blocks supporting the backing feed rolls, shifter shuttle assemblies extending between and attached to each of the first and second backing feed roll assemblies, and at least one cross member extending substantially across the tufting zone and mounted to the shifter shuttle assemblies.

11. The tufting machine of claim 10, further comprising a plurality of upper bearing assemblies mounted at spaced locations along the at least one cross member and configured to engage guide tracks mounted to the frame of the tufting machine for guiding the transverse shifting movement of the second backing feed rolls.

12. The tufting machine of claim 10, wherein the roll stabilizing blocks of at least the first backing feed roll assembly are pivotally mounted to their lateral supports to enable adjustment of an elevation of the backing feed rolls thereof.

13. The tufting machine of claim 9, wherein the framework comprises a pair of spaced shifter shuttle assemblies with at least one cross member extending therebetween and substantially across the tufting zone; and further comprising a series of shift support plates mounted to the frame of the tufting machine and having guides configured to be engaged by bearing assemblies located along the at least one cross member for guiding the transverse shifting of the backing feed rolls.

14. The tufting machine of claim 9, further comprising an adjustment mechanism linked to at least one of the first or second backing feed roll assemblies and to the tufting machine for adjusting an elevation of the backing feed rolls of at least one of the first or second backing feed roll assemblies.

* * * * *